US007004595B1

(12) United States Patent
Stoddard

(10) Patent No.: US 7,004,595 B1
(45) Date of Patent: Feb. 28, 2006

(54) ILLUMINATED ELECTRICAL PLUG ADAPTER

(76) Inventor: James Marshall Stoddard, 509 Yampa Ave., Craig, CO (US) 81625

( * ) Notice: Subject to any disclaimer, the term of this patent is extended or adjusted under 35 U.S.C. 154(b) by 83 days.

(21) Appl. No.: 10/800,304

(22) Filed: Mar. 12, 2004

(51) Int. Cl.
*H01R 3/00* (2006.01)

(52) U.S. Cl. ..... 362/95; 362/114; 362/190; 439/490; 439/107

(58) Field of Classification Search ..... 362/95, 362/114, 119, 190, 629; 439/490, 107
See application file for complete search history.

(56) References Cited

U.S. PATENT DOCUMENTS 4,350,407 A * 9/1982 Tong ..... 439/490
5,007,857 A * 4/1991 Wright ..... 439/490
6,290,533 B1 9/2001 Major

* cited by examiner

*Primary Examiner*—Stephen Husar
*Assistant Examiner*—Hargobind S. Sawhney

(57) ABSTRACT

An Illuminated electrical plug adapter assembly (202) utilizing an Illuminating module assembly (201) comprising Light emitting diode (106), Controlling means (104) and Battery (103), removably contained within Adapter body (135). The Illuminated electrical plug adapter (202) is designed for attachment onto the plug of an existing power cord for the purpose of providing illumination while attaching the plug to an electrical receptacle. Illuminating module assembly (201B) may also be contained within Wall mount transformer case (143). The light emitting diode (106) is positioned to illuminate an electrical receptacle to provide a lighted and clear view, enabling user to safely and accurately connect the plug to the receptacle.

4 Claims, 6 Drawing Sheets

Fig. 1
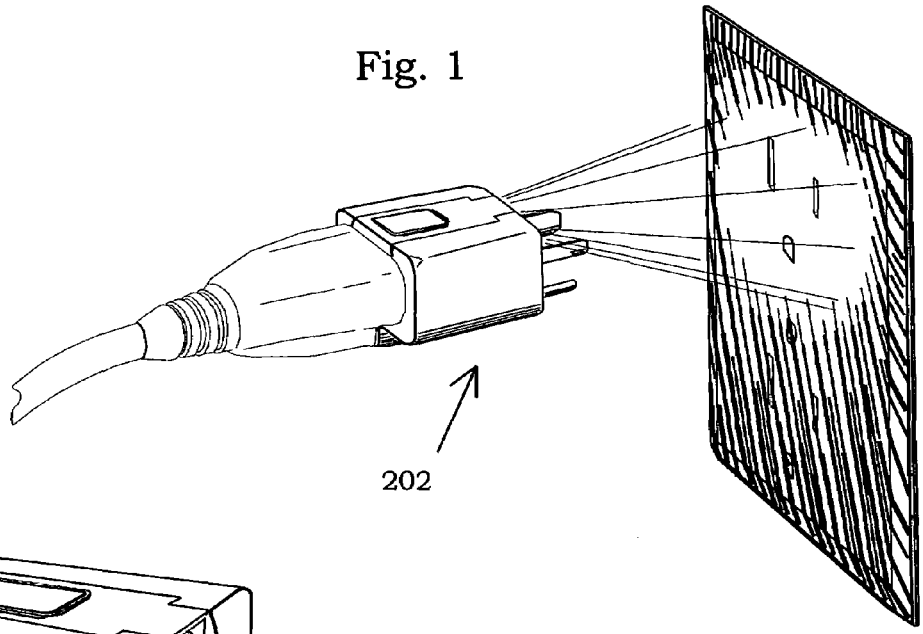
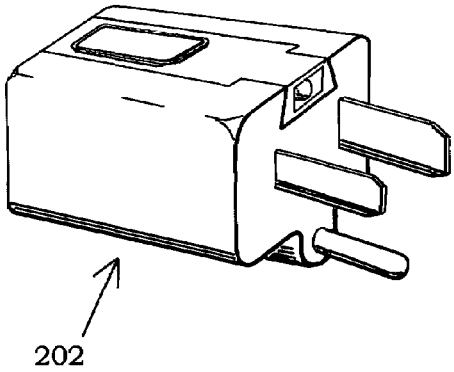
Fig. 2
Fig. 3
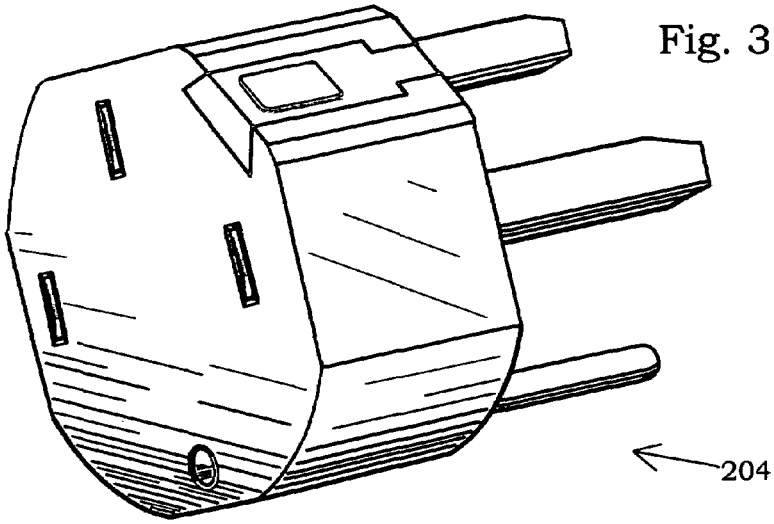

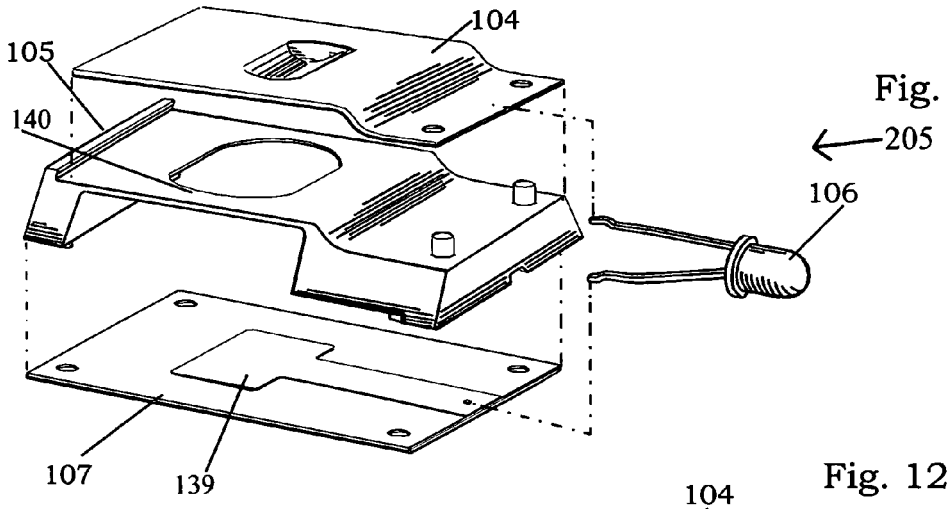
Fig. 11
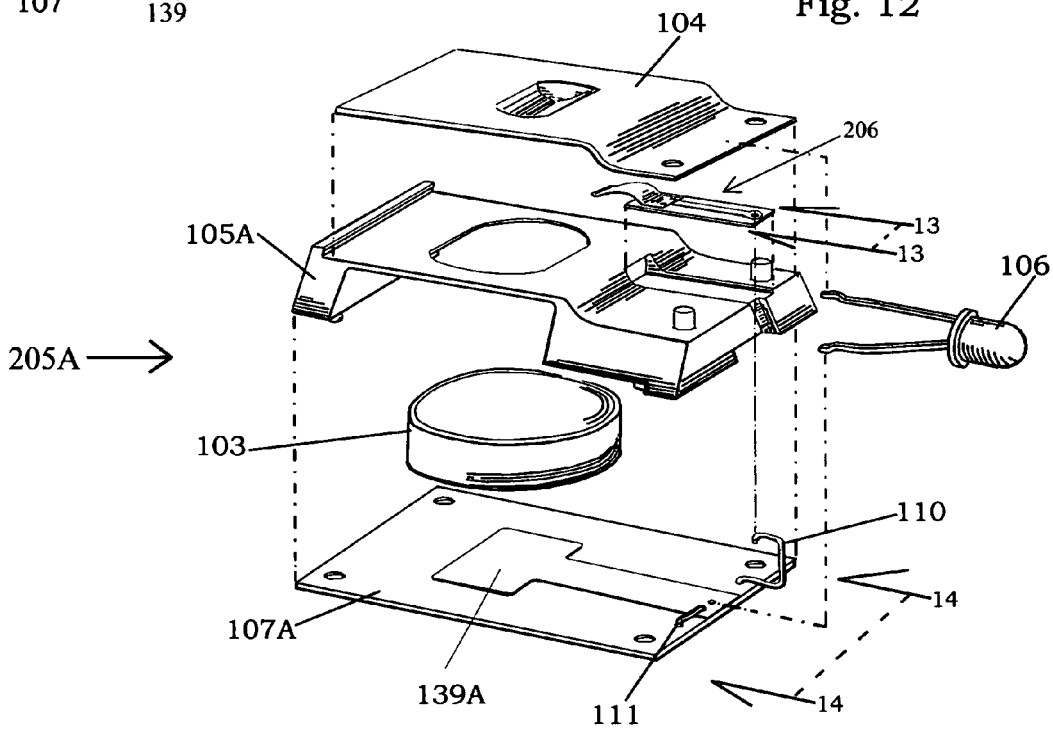
Fig. 12
Fig. 13
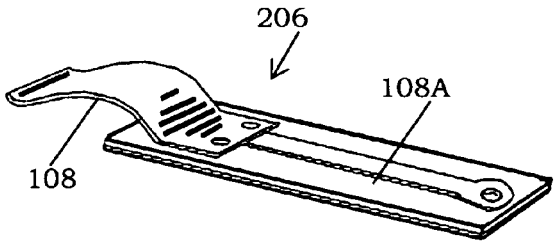
Fig. 14
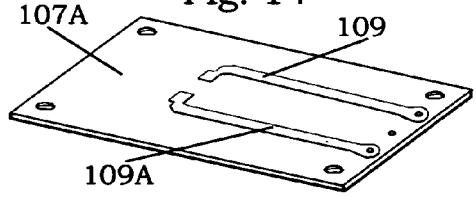

ILLUMINATED ELECTRICAL PLUG ADAPTER

BACKGROUND OF THE INVENTION

Presently existing electrical plugs are very common and vital components providing a convenient and safe way to quickly provide power to electrical devices.

There are situations where plugging a device into a outlet can be somewhat difficult; one such example is attempting to align a plug to an electrical outlet where the outlet is obscured by darkness.

U.S. Pat. No. 6,290,533 (2001) to Major discloses a flashlight plug which is an illuminated male electrical plug & cord. It is designed to illuminate an electrical outlet while a user is in the process of attaching the plug to the receptacle. Drawbacks to this device include: disclosed in the form of a plug/cord, it cannot be used on existing devices without replacing the original electrical cord. Considering the vast difference of electrical cord designs, including mounting, strain relief, amperage ratings, and differences of electrical attachment found on electrical appliance power cords, providing this plug/cord with a safe and suitable universal design could become a very daunting and expensive proposal. Incorrect installation of the Flashlight Plug may cause potential for electrical shock and damage to the appliance. If not provided by the manufacturer as original equipment, to mount this plug/cord on an existing appliance may void a warranty (for equipment with a warranty). Even if this plug were designed to replace the plug component of an existing power cord (cutting off the plug and attaching the Flashlight Plug to the end of the power cable), the same hazards and shortcomings as mentioned above may still apply. For appliances using a wall mount transformer, this plug/cord, or plug only, is of no practical use. While this plug may be a useful device for a manufacturer to install as original equipment on electrical appliances, it has very limited use as a replacement cord or plug on the vast majority of existing appliances. Additionally, once the Flashlight Plug is installed onto an appliance, it becomes a semi-permanent component of that appliance and cannot easily be unattached for use on other electrical devices.

It becomes apparent that an illuminated adapter for receptacle illumination, designed for temporary attachment to existing power cords can be useful and provide substantial improvement over an illuminated power cord or plug. No illuminated adapter designed for receptacle illumination could be found in the prior art.

BACKGROUND OF THE INVENTION—OBJECTS AND ADVANTAGES

Several objects and advantages of the present invention are:

(a) to provide the Illuminated electrical plug adapter using a light diode as the light source;

(b) to provide the Illuminated electrical plug adapter using a small and switch to provide and control power to the light emitting diode;

(c) to provide the Illuminated electrical plug adapter using an electrical circuit for recharging the battery;

(d) to design the Illuminated Electrical adaptor to fit on several types of existing power cord/plug assemblies.

(e) to design the Illuminated Electrical adaptor for attachment to a wall mount transformer.

Still further objects and advantages will become apparent from a consideration of the ensuing description and drawings.

SUMMARY

In accordance with the present invention, my Illuminated Electrical Plug Adapter comprises a body, a light emitting diode, a power source, a switch, and electrical conductors fashioned to connect to and between an electrical receptacle and a electrical plug.

DRAWINGS—FIGURES

FIG. 1 is a perspective view of the present invention illustrating the intended function of providing this device to connect to a electrical power cord in order to provide illumination onto a electrical receptacle.

FIG. 2 is a perspective view of the present invention.

FIG. 3 is a perspective view of an additional embodiment of the present invention—Illuminated electrical plug adapter for a 220 VAC power cord.

FIG. 11 is an exploded view of the switch and battery holding assembly.

FIG. 12 is an exploded view of the switch and battery assembly modified to allow recharging of the battery.

FIG. 13 is a magnified view of the conductor that connects the battery to a recharging circuit.

FIG. 14 is the inverse side of the circuit board showing the conductors connecting the recharging circuit.

DRAWINGS—REFERENCE NUMERALS

Figure 4:
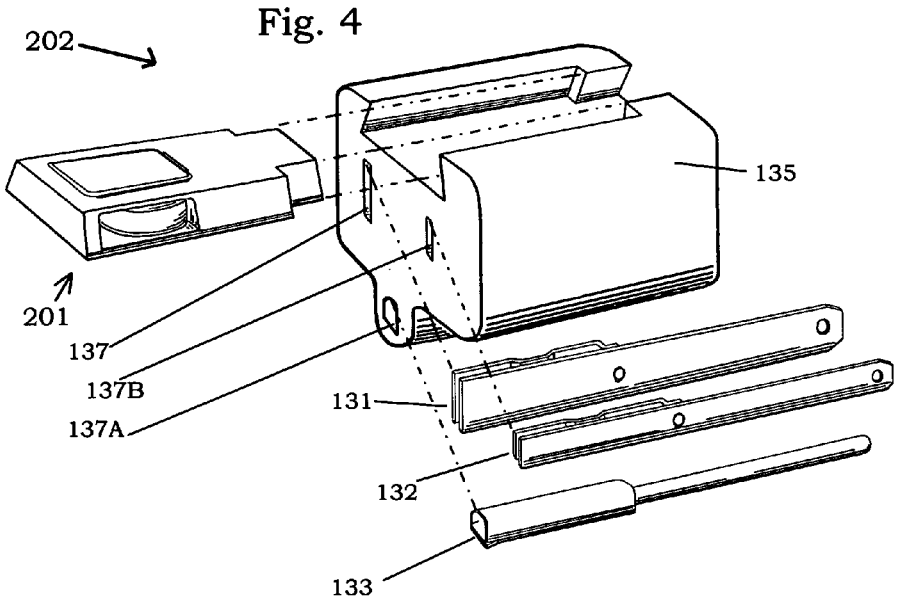
FIG. 4 is an exploded view of the present invention.

100 Light module case
101 Switch Cover
102 Diffusing lens
103 Battery
104 Switch contact
105 Battery & switch holding component
105A Battery & switch holding component for recharging embodiment
106 Light emitting diode
107 Circuit board
107A Circuit board modified for recharging embodiment
108 Spring metal contactor assembly

108A Circuit board for spring
109, 109A Circuit board for spring metal contactor
110, 111: Wire conductor
112 Resistor
113 Recharging contact board
113A, 113B: Wire—recharging circuit
113C Location of recharging contact board
115 Wire, fuse link—to recharging assembly
115A, 115B: Wire—to recharging assembly
116 Transformer—recharging assembly
117 Circuit board—recharging assembly
119, 119A, 119B, 119C: Rectifier
120 Recharging circuit
130 Power conductor—grounding lug
131, 132, 133: Power conductor
135 Adapter body—preferred embodiment
136 Adapter body—recharging embodiment
137, 137A, 137B: Socket openings embodiment
138 Opening—battery installation & replacement
139 Conductor
139A Conductor
140 Spacer equipment
141 Illuminating module bracket
142 Adhesive panel
143 Wall mount transformer case
201 Illuminating module of the preferred embodiment
201A Illuminating module—recharging embodiment
201B Illuminating module—wall transformer embodiment
202 Illuminated electrical plug adapter assembly of the preferred embodiment
203 Illuminated electrical plug adapter assembly—additional embodiment
204 Illuminated electrical plug adapter assembly—additional embodiment, for 220 volt
205 Switch & battery holder assembly
205A Switch & battery holder assembly—recharging embodiment
206 Battery contactor assembly
207 Recharging assembly
208 Additional embodiment—Illuminated multiple output adapter assembly
209 Existing Power Transformer assembly

DETAILED DESCRIPTION—FIGS. 1, 2, 4, 8, 9, 10, 11, 19—PREFERED EMBODIMENT

For purpose toward promoting an understanding of the principles of the invention, reference will now be made to the embodiments illustrated in the drawings. Specific language will be used to describe same. It will, nevertheless, be understood that no limitation of the scope of the invention is thereby intended, such alterations and further modifications of the illustrated device, and such further applications of the principles of the invention as illustrated herein being contemplated as would normally occur to one skilled in the art to which the invention relates.

Certain terminology is used in the following description for convenience only and is not limiting. The words "right", "left", "upper", "lower", "inside", "outside", and "in front of" designate the placement and location of components from the user's point of view. The word "user" is to mean a person using the illuminated electrical plug adapter. The words "led"and "leds" are used throughout as a shortened term for "light emitting diode" and "light emitting diodes". The word "power cord" is used to describe an electrical cord/plug assembly. The word "power cable" is used to describe an electrical cable without a plug. The terminology includes the words above specifically mentioned, derivatives thereof and words of similar import.

FIGS. 1 & 2 show two views of the Illuminated electrical plug adapter assembly 202; FIG. 1. illustrating use of the device.

Referring now to FIG. 4 of the drawing, device 202 is shown comprising Illuminating module assembly 201, removably held frictionally or by other suitable means in place by Adapter body 135 which also holds Power conductors 131, 132, and 133; permanently held in place by any suitable means. Adapter body 135 is made of any suitable non-conductive material.

Figure 8:
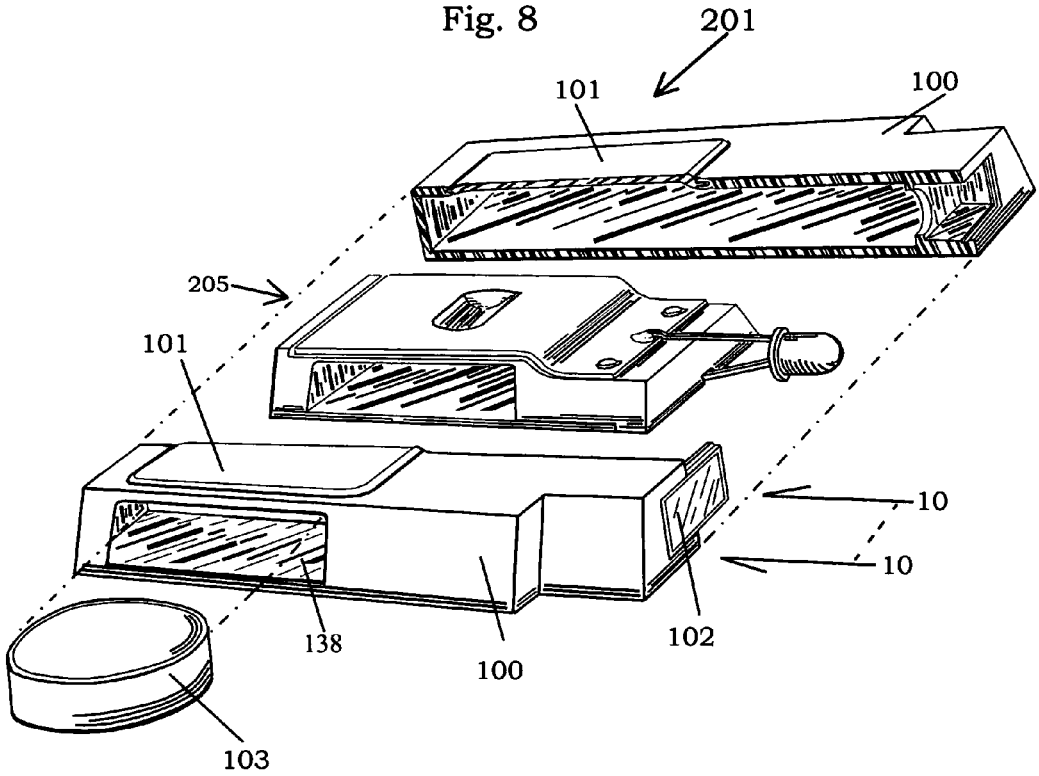
FIG. 8 is an exploded view of the lighting components.
Figure 9:
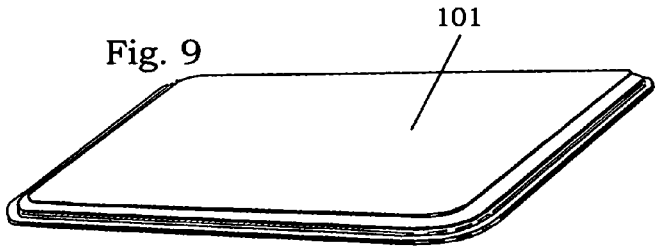
FIG. 9 is a magnified view of the flexible switch cover.
Figure 10:
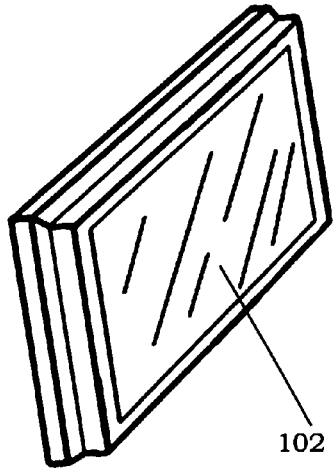
FIG. 10 is a magnified view of the diffusing lens.

Referring now to FIG. 8 of the drawing, Illuminating module assembly 201 comprises Illuminating module case 100 and Switch cover 101 (FIG. 9) which encloses Switch & battery holder assembly 205 and Battery 103. Switch cover 101 is molded or attached by any suitable means, or is a part of Illuminating module case 100 in order to provide a flexible seal which allows user to actuate Switch & battery holder assembly 205. Opening 138 allows installation and replacement of Battery 103. Diffusing lens 102 (FIG. 10) is made of a suitable transparent material and is molded or attached by any suitable means to Illuminating module case 100.

FIG. 11 of the drawing shows Switch & battery holder assembly 205. This assembly comprises Switch contact 104, Battery & switch holding component 105, Circuit board 107, and Light emitting diode 106. The Battery & switch holding component 105 is made of a non-conductive material and is sandwiched between Circuit board 107 and Switch contact 104; these components are adhesively combined or held together by any suitable means. This assembly forms Opening 138 (FIG. 8), which holds Battery 103 (FIG. 8) in place within the assembly and maintains electrical contact with Conductor 139. Spacer section 140 creates a space between Switch contact 104 and Battery 103. Switch contact 104 is electrically conductive and has a flexible characteristic enabling contact with the battery—a predetermined amount of force applied to the contact in a direction towards the battery causes physical and electrical contact with battery 103. Light emitting diode 106 is electrically connected to Conductor 139 and Switch contact 104. When Switch contact 104 is electrically connected to Battery 103, electron flow through Led 106 is started and Led 106 will produce useful illumination.

Figure 19:
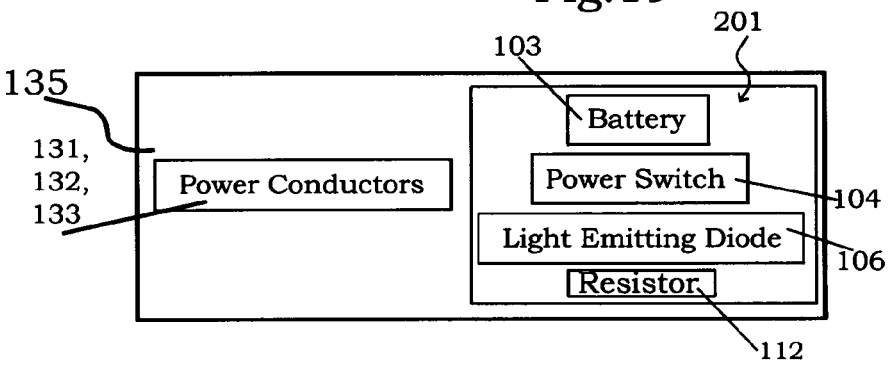
FIG. 19 is an electronic diagram of the preferred embodiment of the present invention.

FIG. 19 shows the electrical diagram of the preferred invention. Adapter body 135 houses Power conductors 131, 132 & 133, which allow electron flow from a receptacle, through the assembly and to any plug connected to the Illuminated Electrical Plug adapter. Illuminating module assembly 201 is the switching mechanism for LED 106–the actual switching component is Switch contact 104. Switch contact 104 closes the circuit by electrically connecting Battery 103 to Led 106. Resistor 112, if needed is an amperage controlling component for LED 106.

DETAILED DESCRIPTION—FIGS. 2, 3, 5, 6, 7, 12, 13, 14, 15, 16, 17, 20—ADDITIONAL EMBODIMENTS

Figure 5:
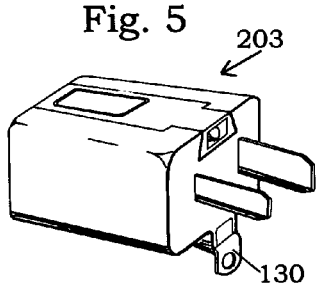
FIG. 5 is a perspective view of another embodiment of the present invention.

Referring now to FIG. 5, showing the Illuminated Electrical Plug adapter designed as a grounding adapter. Identical to Illuminated electrical plug adapter assembly 202 (FIG.

2) except for the differently shaped Power conductor 130, Illuminated electrical plug adapter assembly 203 uses Power conductor 130, more accurately described as Grounding lug 130 to enable an electrical connection through the cover screw and to the electrical ground of older style wall plate receptacles not having a grounding jack.

Illuminated electrical plug adapter assembly 203 uses Illuminating module assembly 201 (FIG. 5) in order to provide illumination for the user.

Figure 17:
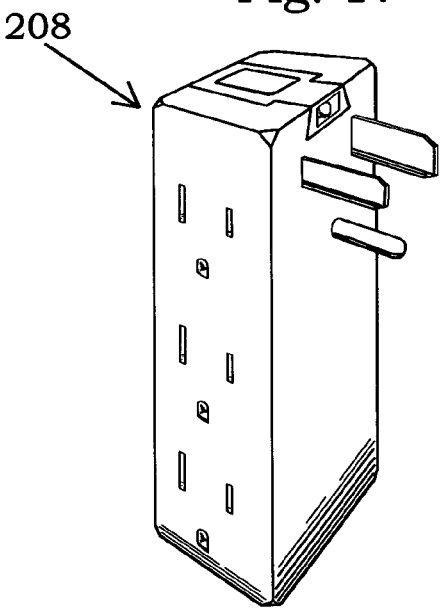
FIG. 17 is a perspective view of another embodiment of the present invention.

Additional embodiments include 220 VAC Illuminated Electrical Plug Adapter assembly 204 (FIG. 3) and Illuminated multiple output electrical plug adapter assembly 208 (FIG. 17).

Figure 6:
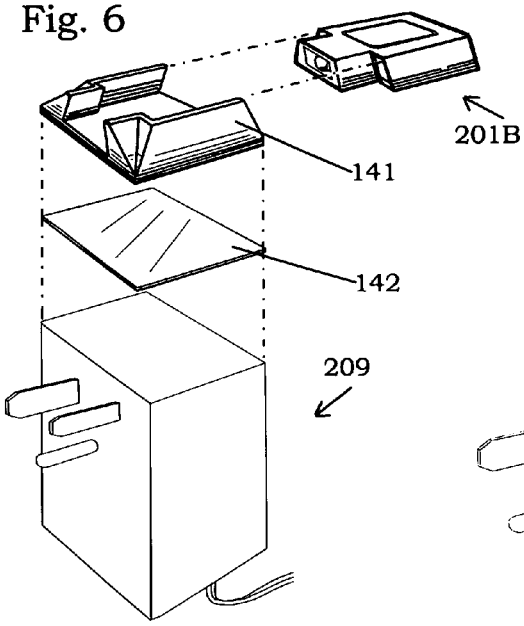
FIG. 6 is an exploded view of additional embodiment—Adhesive mount.

FIG. 6 discloses another embodiment comprising Bracket 141 and Adhesive panel 142, designed to attach to an existing wall mount transformer 209. Adhesive panel 142 is adhesive on both sides to attach bracket 141 to Transformer 209, but any suitable means of affixation may be used. Illuminating module 201B is held in position by means of friction or any suitable means as is known in the art into bracket 141 in order to provide lighting onto an intended receptacle.

Figure 7:
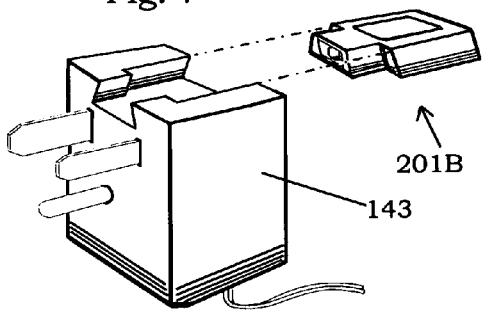
FIG. 7 is an exploded view of additional embodiment—Wall transformer case mount.

FIG. 7 shows another mounting design for attaching illuminating module 201B to a wall mount transformer. Wall mount transformer case 143 is designed to hold Illuminating module 201B.

Figure 15:
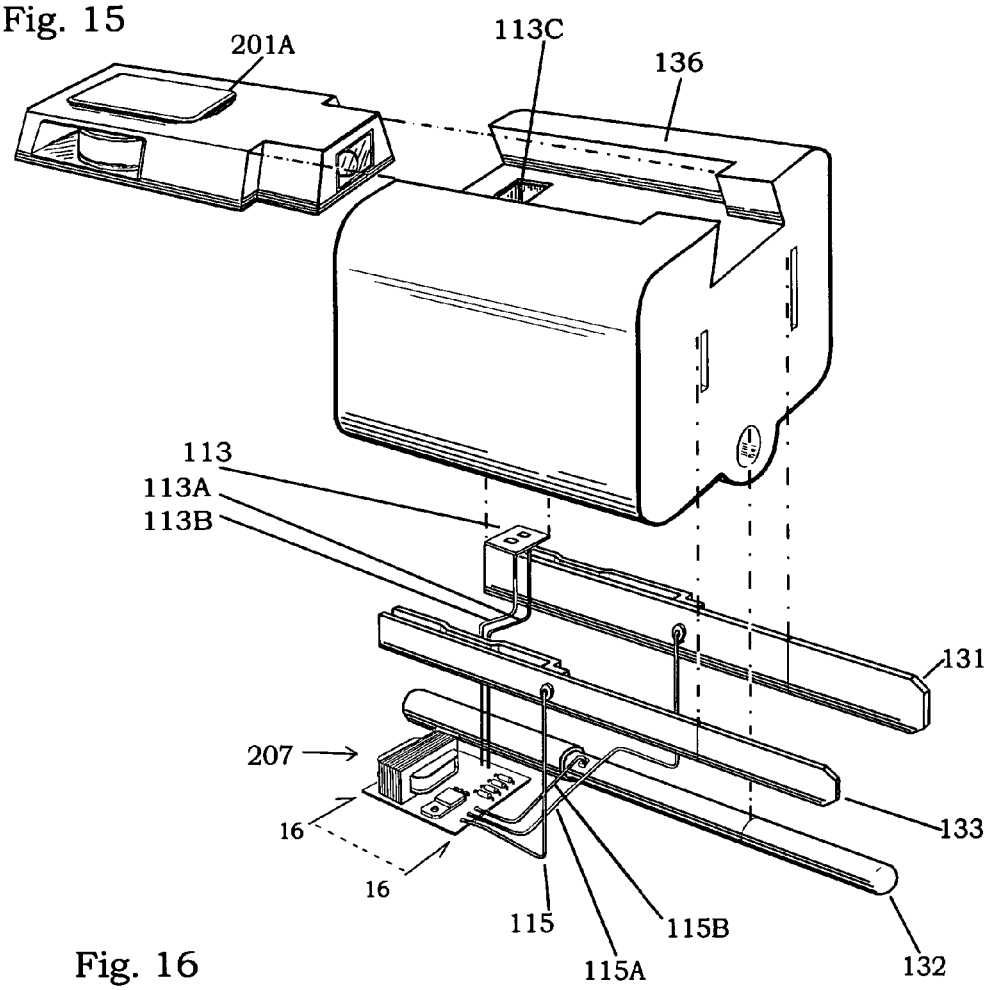
FIG. 15 is an exploded view of another embodiment of the present invention showing the addition of recharging components.

Other embodiments may include a recharging circuit for Battery 103 (FIG. 12). FIG. 15 shows how Recharging assembly 207 locates within Adapter body 137. Recharging assembly 207 (FIG. 16) contains the components to allow recharging functions as explained following.

Figure 16:
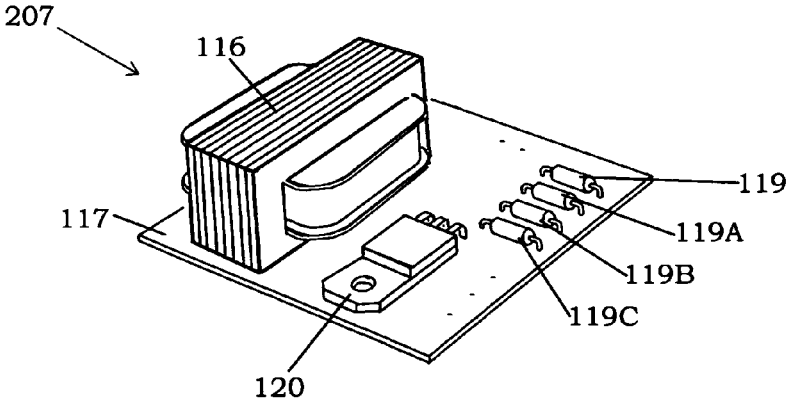
FIG. 16 is a magnified perspective view of the recharging circuitry.

Referring again to FIG. 15, the recharging constituent begins with Power conductors 115, 115A and 115B. They function to convey line voltage to Recharging assembly 207. FIG. 16 shows a magnified perspective view of this assembly. The line voltage is stepped down to a suitable voltage by Transformer 116 and sent to Rectifier 119–119C. The DC voltage from the rectifier provides power to Recharging circuit 120, which may be any suitable recharging circuit as is known in the art to maintain the charge level of Battery 103 (FIG. 12). Referring to FIG. 15, Conductors 113A & 113B, through Recharging contact board 113, connect the output voltage from Recharging circuit 120 to Illuminating module assembly 201A. FIG. 14 shows the bottom of Circuit board 107A. Conductors 109 & 109A electrically connect Recharging contact board 113 (FIG. 15) to Wires 110 & 111 (FIG. 12) The presence of Recharging contact board 113 eliminates need to hardwire Illuminating module assembly 201A to the recharging circuit, allowing for simple removal and replacement of the assembly as shown in FIG. 15. When Illuminating module assembly 201A is installed in Adapter body 137, Recharging contact board 113 physically aligns and electrically connects to Conductors 109 & 109A (FIG. 14.) Wire 111 is a jumper from Conductor 109 to Conductor 139A, connecting the circuit to (refer to FIG. 12) one pole of Battery 103. Wire 110 electrically connects the recharging voltage to Battery contactor assembly 206, which closes the recharging circuit. Battery contactor assembly 206 is shown in FIG. 13 and consists of two parts: Circuit board 108A and Spring metal contactor 108. This component maintains electrical contact with and allows voltage to flow to Battery 103 (FIG. 12) any time the illuminated electrical plug adapter is connected to an active receptacle.

Figure 20:
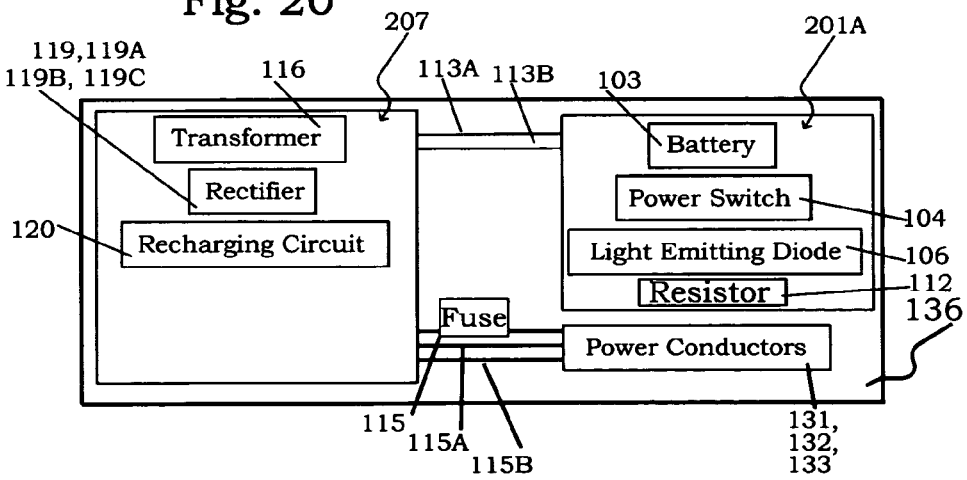
FIG. 20 is an electronic diagram of another embodiment of the present invention modified for recharging of the battery.

FIG. 20 is an electrical diagram showing Recharging circuit 120 within Adapter body 136.

OPERATION OF PREFERRED EMBODIMENT AND ADDITIONAL EMBODIMENTS—FIGS. 1, 2, 3, 4, 5, 6, 7, 8, 11, 15, 16, 17,

As illustrated in FIG. 1, the function of Illuminated electrical plug adapter assembly 202 is to illuminate a receptacle so a user can see to align and connect the plug safely & accurately in dark situations. To operate, insert the power cord of the device into the socket openings 137–137B located on the back of Illuminated plug adapter assembly 202 (FIG. 4).

To activate the illumination, a user depresses Switch cover 101 (FIG. 8) which activates the circuit, causing illumination from Light emitting diode 106 (FIG. 11). When user releases or again depresses Switch 101, the illumination will deactivate.

To replace the battery, Illuminating module assembly 201 (FIG. 4) is removed from Adapter body 135 to gain access to Battery 103 (FIG. 8). The battery is removed from Opening 138 and a new battery is installed. Illuminating module assembly 201 is then inserted back into Adapter body 135 (FIG. 15).

In regard to operation and battery replacement, all Illuminated electrical plug adapter assemblies (FIG. 3, 204 FIG. 5, 203, FIGS. 6 & 7, 201B & FIG. 17, 208) operate in the same manner.

The addition of the Recharging assembly 207 (FIG. 16) may be present in Illuminated electrical plug adapter assemblies (FIG. 2) 202, (FIG. 3) 204, (FIG. 5) 203, (FIG. 7 201B and (FIG. 17) 208.

ADVANTAGES

From the description above, a number of advantages of my Illuminated electrical plug adapter become evident:

(a) Use of the adapter provides a directed light source, clearly illuminating the intended electrical receptacle.

(b) Combines the features of separate devices (electrical adapters and portable lighting) into one device. Combined, these features offer a higher level of safety and convenience. An example of this would be the ability to locate and illuminate a receptacle in a darkened area using just the Illuminated Electrical plug adapter.

(c) By illuminating the receptacle, user can see to accurately align and safely insert the power cord.

(d) The illuminating module uses a low power light emitting diode so the battery will have a long run-time. When the battery needs replacement, User can easily replace the battery.

(e) The Illuminated Electrical Plug adapter can utilize a recharging circuit that will keep the battery recharged, enabling very long battery life. Situations where battery life may be shortened by constant use can benefit from use of this configuration.

CONCLUSION, RAMIFICATIONS, AND SCOPE

Accordingly, the reader will see that compared to using a standard plug or adapter, my Illuminated electrical plug adapter can provide a user with an unobtrusive and inexpensive means to more safely and easily perform this very common everyday task of plugging a electrical device into a receptacle. Furthermore, my Illuminated Electrical Plug adapter provides additional advantages in that:

(a) The present invention enables user to easily locate receptacles in dark environments;

(b) The present invention is designed to be used with conventional electrical cords thereby allowing use of the adapter on any device having a corresponding electrical plug.

(c) The illuminating module is removable for battery or module replacement.

(d) The present invention and additional embodiments enable user to provide to a variety of electrical plugs an affordable, temporary, and quick conversion from non-illuminated to illuminated.

Although the description above contains many specificities, these should not be construed as limiting the scope of the invention but as merely providing illustrations of some of the presently preferred embodiments.

Thus the scope of the invention should be determined by the appended claims and their legal equivalents, rather than by the examples given.

I claim:

1. An illuminated electrical plug adapter device for illumination of electrical receptacles, said illuminated electrical plug adapter comprising:

(a) an adapter body, (b) a plurality of electrical power conductors (c) a grounding electrical power conductor (d) an illuminating module, said illuminating module comprising:

(1) a light emitting diode, (2) at least one battery, (3) an enabling means to control electrical power flow from said battery to said light emitting diode, said adapter body encasing a portion of said electrical power conductors, wherein an electrical plug is insertable in said adapter body to electrically communicate with said plurality of electrical power conductors, a remaining portion of said plurality of electrical power conductors extending beyond said adapter body, wherein said remaining portion of said plurality of electrical conductors may be inserted into and electrically communicate with said electrical plug is insertable in said an electrical receptacle to electrically communicate with said electrical receptacle, said adapter body encasing a portion of said grounding electrical power conductor, wherein said electrical plug is insertable in said adapter body to electrically communicate with said grounding electrical power conductor, a remaining portion of said grounding electrical power conductor extending beyond said adapter body, wherein said remaining portion of said grounding electrical power conductor is insertable in said electrical receptacle to electrically communicate with said electrical receptacle, said adapter body removably holding said illuminating module, wherein said light emitting diode, when activated, being positioned to illuminate an area forward of said remaining portion of said plurality of said power conductors, and whereby a user may attach said illuminated electrical plug adapter to an existing power cord plug for the purpose of illuminating a receptacle.

2. The illuminating electrical plug adapter of claim 1 wherein said remaining portion of said grounding electrical power conductor being fashioned as a lug, said lug electrically communicating to ground through a screw attached through said lug to an electrical receptacle.

3. The illuminating electrical plug adapter of claim 1, further including a recharging circuit embedded within said adapter body, an electrical connection means removably connecting said recharging circuit to said battery, wherein said recharging circuit providing electrical power for recharging of said battery.

4. The illuminating electrical plug adapter of claim 1, wherein said adapter body encasing said portion of said electrical power conductors being fashioned to enable a plurality of electrical plugs to simultaneously be inserted and electrically communicate with said plurality of electrical power conductors, said adapter body encasing said portion of said grounding electrical power conductor being fashioned to enable a plurality of electrical plugs to simultaneously be inserted and electrically communicate with said grounding electrical power conductor.

* * * * *